US006513478B2

(12) United States Patent
Tsubouchi

(10) Patent No.: US 6,513,478 B2
(45) Date of Patent: Feb. 4, 2003

(54) GENERATOR MOUNTING ARRANGEMENT FOR VERTICAL ENGINES AND OUTBOARD MARINE DRIVES

(75) Inventor: Masanori Tsubouchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/935,014

(22) Filed: Aug. 21, 2001

(65) Prior Publication Data

US 2002/0023610 A1 Feb. 28, 2002

(30) Foreign Application Priority Data

Aug. 25, 2000 (JP) ..... 2000-255995

(51) Int. Cl.[7] ..... F02B 77/00
(52) U.S. Cl. ..... 123/195 A
(58) Field of Search ..... 123/195 A, 195 R

(56) References Cited

U.S. PATENT DOCUMENTS 3,730,147 A * 5/1973 Buchwald ..... 123/195 A
4,633,828 A * 1/1987 Steele ..... 123/198 R
4,849,665 A * 7/1989 Kitamura et al. ..... 123/195 E
4,899,703 A * 2/1990 Buferne ..... 123/195 A
5,938,169 A * 8/1999 Ogawa et al. ..... 123/195 A
6,098,950 A * 8/2000 Zupan et al. ..... 123/195 A
6,324,744 B1 * 12/2001 Banks et al. ..... 123/195 A
6,360,712 B1 * 3/2002 Banks et al. ..... 123/198 R

FOREIGN PATENT DOCUMENTS

JP 10-175596 6/1998

* cited by examiner

*Primary Examiner*—Gene Mancene
*Assistant Examiner*—Jason Benton
(74) *Attorney, Agent, or Firm*—MacPherson Kwok Chen & Heid LLP

(57) ABSTRACT

Provided is a compact generator mounting arrangement for vertical engines and outboard marine drives. The generator is mounted via brackets integrally cast with the crankcase of the engine. The brackets can be conveniently reinforced by a hollow ridge which is integrally cast with said crankcase to define an oil gallery therein. Thus, sturdy generator mounting brackets can be formed without increasing the cost and weight.

4 Claims, 5 Drawing Sheets

GENERATOR MOUNTING ARRANGEMENT FOR VERTICAL ENGINES AND OUTBOARD MARINE DRIVES

TECHNICAL FIELD

The present invention relates to a generator mounting arrangement for vertical engines and a generator mounting arrangement for outboard marine drives equipped with a vertical engine.

BACKGROUND OF THE INVENTION

A large outboard marine engine is typically equipped with a generator in the form of an ACG. An ACG is typically secured to a cylinder block or crankcase via steel brackets. Japanese patent laid open (kokai) publication No. 10-175596 filed by the same applicant discloses an arrangement in which a relatively large bracket is secured to an upper end of the crankcase to thereby support an ACG. However, the bracket is subjected to the tension that acts upon the ACG drive belt, and is required to support the relatively heavy ACG as a cantilever so that the bracket tends to be large in size. Furthermore, because the bracket is attached to the crankcase having a limited mechanical strength to withstand the load, a relatively large mounting area must be secured in the crankcase and/or the crankcase is required to be reinforced.

BRIEF SUMMARY OF THE INVENTION

In view of such problems of the prior art, a primary object of the present invention is to provide a generator mounting arrangement for vertical engines which is highly compact, and a generator mounting arrangement for an outboard marine drive equipped with such an engine.

A second object of the present invention is to provide a generator mounting arrangement for vertical engines which is economical to implement, and a generator mounting arrangement for an outboard marine drive equipped with such an engine.

A third object of the present invention is to provide a generator mounting arrangement for vertical engines which is light in weight, and a generator mounting arrangement for an outboard marine drive equipped with such an engine.

According to the present invention, such objects can be accomplished by providing a generator mounting arrangement for vertical engines having a substantially vertically oriented crankshaft, a cylinder block having a cylinder axial line disposed substantially horizontally, a cylinder head attached to a corresponding side of the cylinder block to define a combustion chamber, a crankcase fixedly attached to another side of the cylinder block to define a crank chamber accommodating the crankshaft, a generator fixedly attached to an outer side of the crankcase and having an input shaft extending vertically upward, a driven pulley secured to the generator input shaft, a drive pulley attached to an upper end of the crankshaft, and an endless belt passed around the two pulleys, wherein: the generator is fixedly attached to the crankcase via a bracket integrally cast with the crankcase. The same arrangement may also be used for outboard marine drives.

Thus, the generator mounting arrangement having an adequate mechanical strength can be ensured in a highly compact manner without increasing the cost and weight. Typically, at least two brackets are integrally cast with the crankcase, one being provided with a pivot hole for pivotally supporting the generator, the other being provided with an arcuate slot for fixedly securing the generator at a desired angular position around the pivot hole.

According to a particularly preferred embodiment of the present invention, a hollow ridge is integrally cast with the crankcase to define an oil gallery therein, and connected to the bracket.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
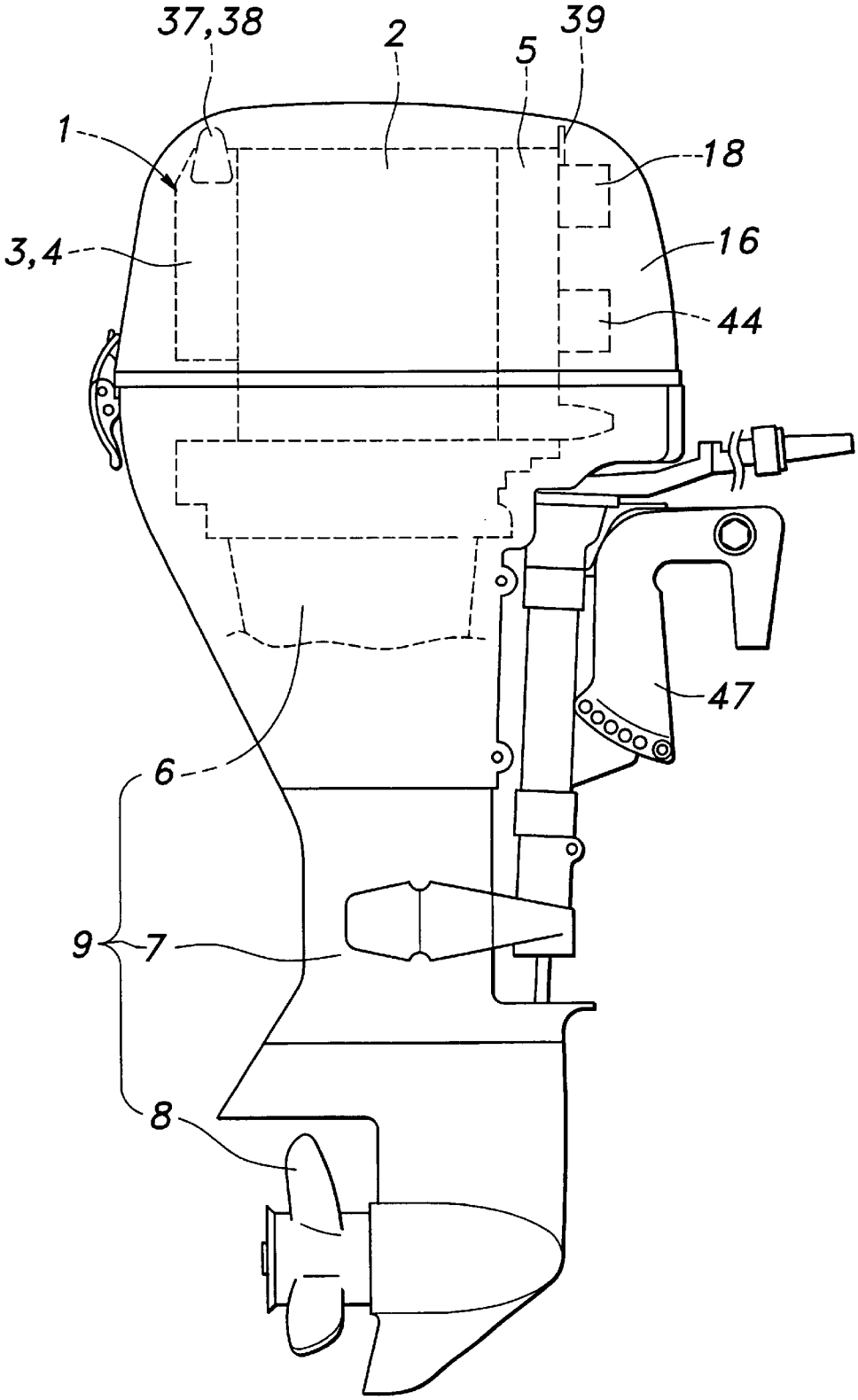
FIG. 1 is a side view of an outboard marine drive equipped with a V-type vertical engine embodying the present invention.
Figure 2:
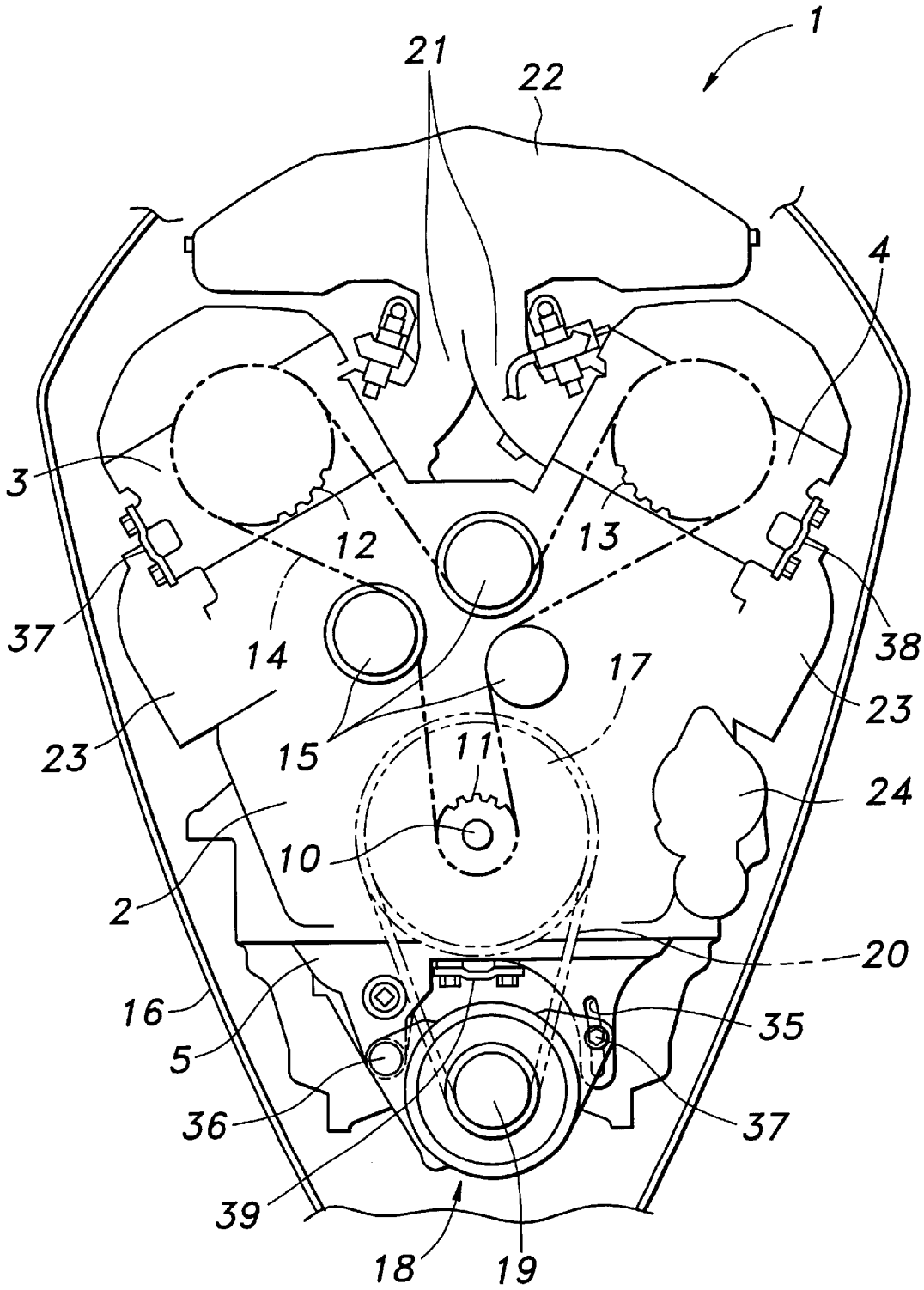
FIG. 2 is a plan view showing an essential part of the V-type vertical engine shown in FIG. 1.

FIGS. 1 and 2 show an outboard marine drive equipped with a V-type vertical engine 1 embodying the present invention. This engine 1 consists of a V-type six-cylinder engine, and comprises a V-shaped cylinder block 2 having a pair of cylinder banks, a crankcase 5, and a pair of cylinder heads 3 and 4. The engine 1 is covered by a cowling 16. The lower end of the engine 1 is connected to a propulsion unit 9 including a gear housing 6, a screw 8 and an extension case 7 accommodating a power train leading to the screw 8.

To the upper end of a crankshaft 10 is connected a camshaft drive pulley 11, and to the upper end of a camshaft (not shown in the drawing) provided in each cylinder head is connected a camshaft driven pulley 12, 13. A timing belt 14 is passed around the camshaft drive pulley 11 and camshaft driven pulleys 12 and 13, and is guided and appropriately tensioned by three idle pulleys 15 including a tension pulley.

To the upper end of the crankshaft 10 is fixedly attached an ACG drive pulley 17, and an ACG drive endless belt 20 is passed around the ACG drive pulley 17 and an ACG driven pulley 19 attached to an input shaft of an ACG 18 fixedly attached to the crankcase 5.

The inner sides of the cylinder heads 3 and 4 opposing each other support a common intake device 22 via an intake manifold 21 attached to each cylinder head 3, 4. The outer sides of the cylinder heads 3 and 4 are provided with exhaust manifolds 23, respectively. On one side of the cylinder block 2 is mounted a starter motor 24.

Figure 5:
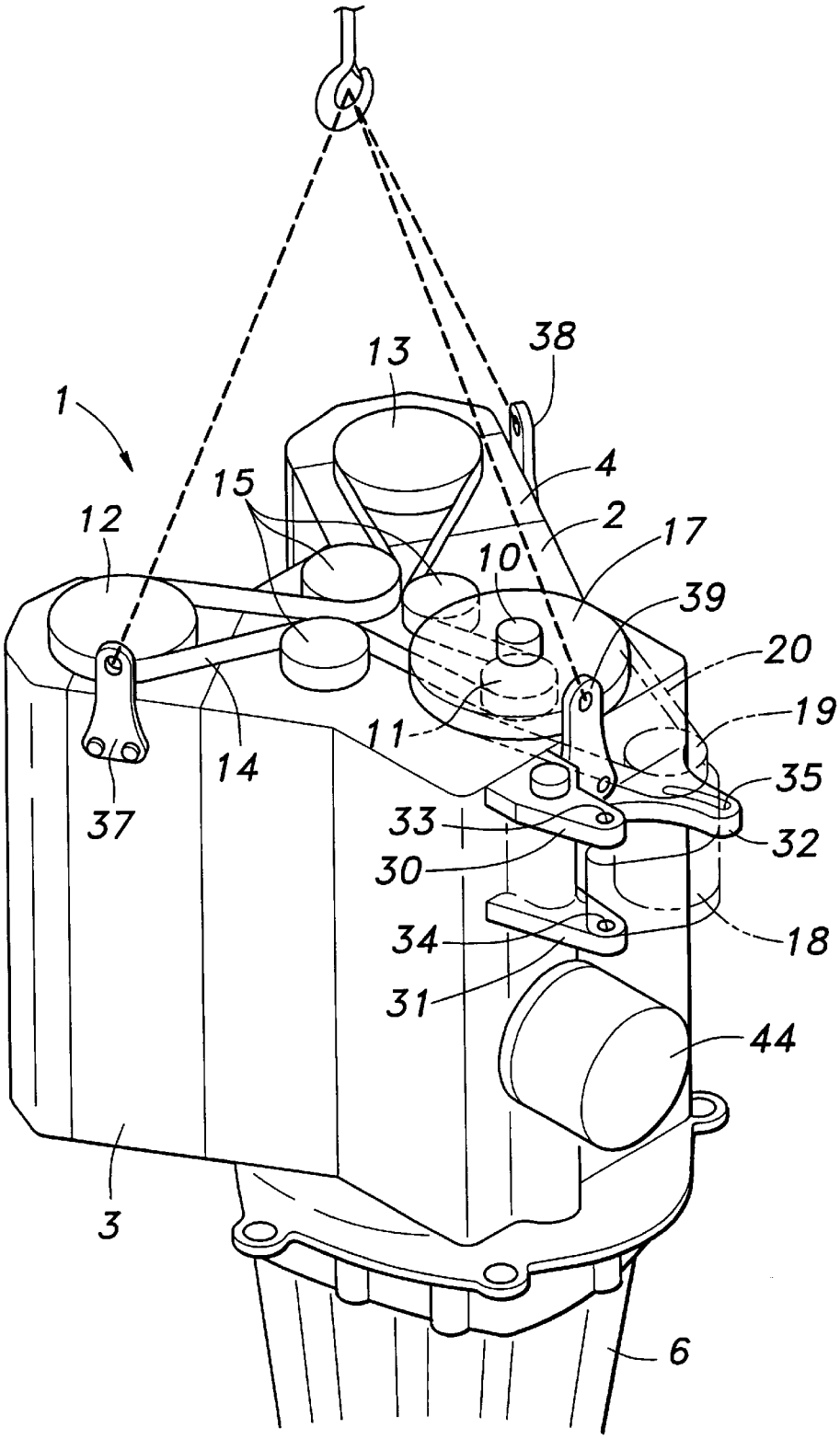
FIG. 5 is a perspective view showing the mode of hoisting the V-type vertical engine shown in FIG. 1.

As best shown in FIG. 5, brackets 30, 31 and 32 are integrally cast on the outer surface of the crankcase 5 to attach the ACG 18, and project laterally outward. In this embodiment, these brackets 30, 31 and 32 project outwardly without any overhang so that the mold elements may be removed laterally without any problem when casting the crankcase 5. The first and second brackets 30 and 31 are formed with mounting holes 33 and 34 which align vertically to each other so that the ACG 18 may be pivotally supported around a vertical axial line by passing a threaded bolt 36 through these holes 33 and 34 and a corresponding mounting hole of the ACG 18. The third bracket 32 laterally opposes the other brackets 30 and 31, and is provided with an arcuate slot 35 corresponding to the rotational trajectory of the ACG 18. A threaded bolt 37 is passed through a mounting hole of the ACG 18 and slot 35, and after turning the ACG 18 around the threaded bolt 36 so as to apply a desired tension to the ACG drive endless belt 29, the threaded bolt 37 is fastened to fixedly secure the ACG 18 at this position.

In this embodiment, the three hanger brackets 37, 38 and 39 are attached to the outer sides of the cylinder heads 3 and 5 and an upper central part of the outer surface of the crankcase 5 by using threaded bolts. Therefore, these threaded bolts can be fastened from sideways, and this reduces the possibility of interferences from other component parts. The cylinder heads 3 and 4 have a large wall thickness, and have an adequate mechanical strength to hoist the engine. As for the crankcase 5, the hanger bracket 39 is secured to a base of the first ACG mounting bracket 30 which may be given with a desired wall thickness. In particular, by using three points for hoisting the engine as shown in FIG. 5, the hanger brackets can be secured to the parts of the engine which are relatively peripheral to the engine and relatively free from the interferences from other components, and the engine may be hoisted in a stable manner.

Figure 3:
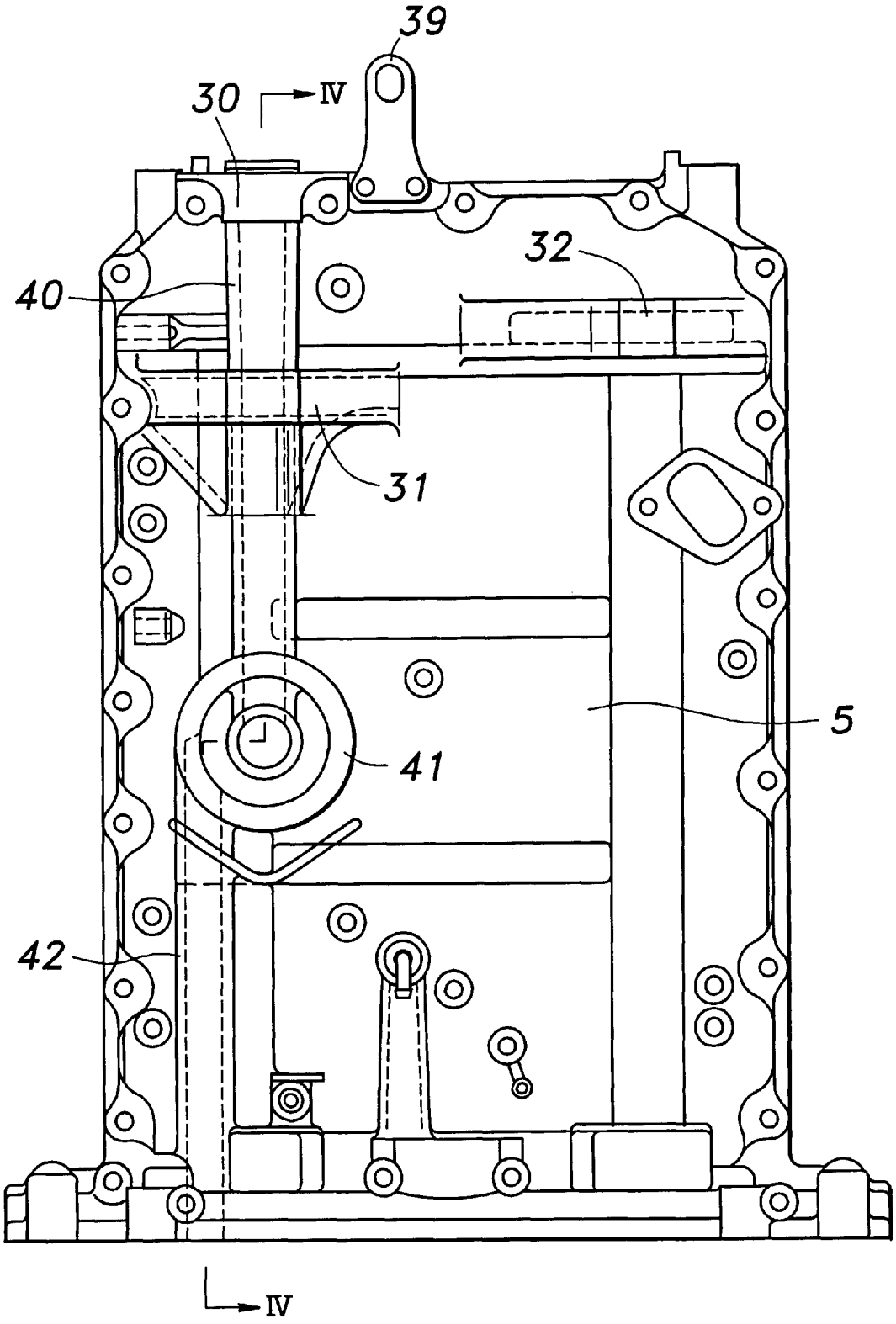
FIG. 3 is a bottom view showing the crankcase of the V-type vertical engine shown in FIG. 1.
Figure 4:
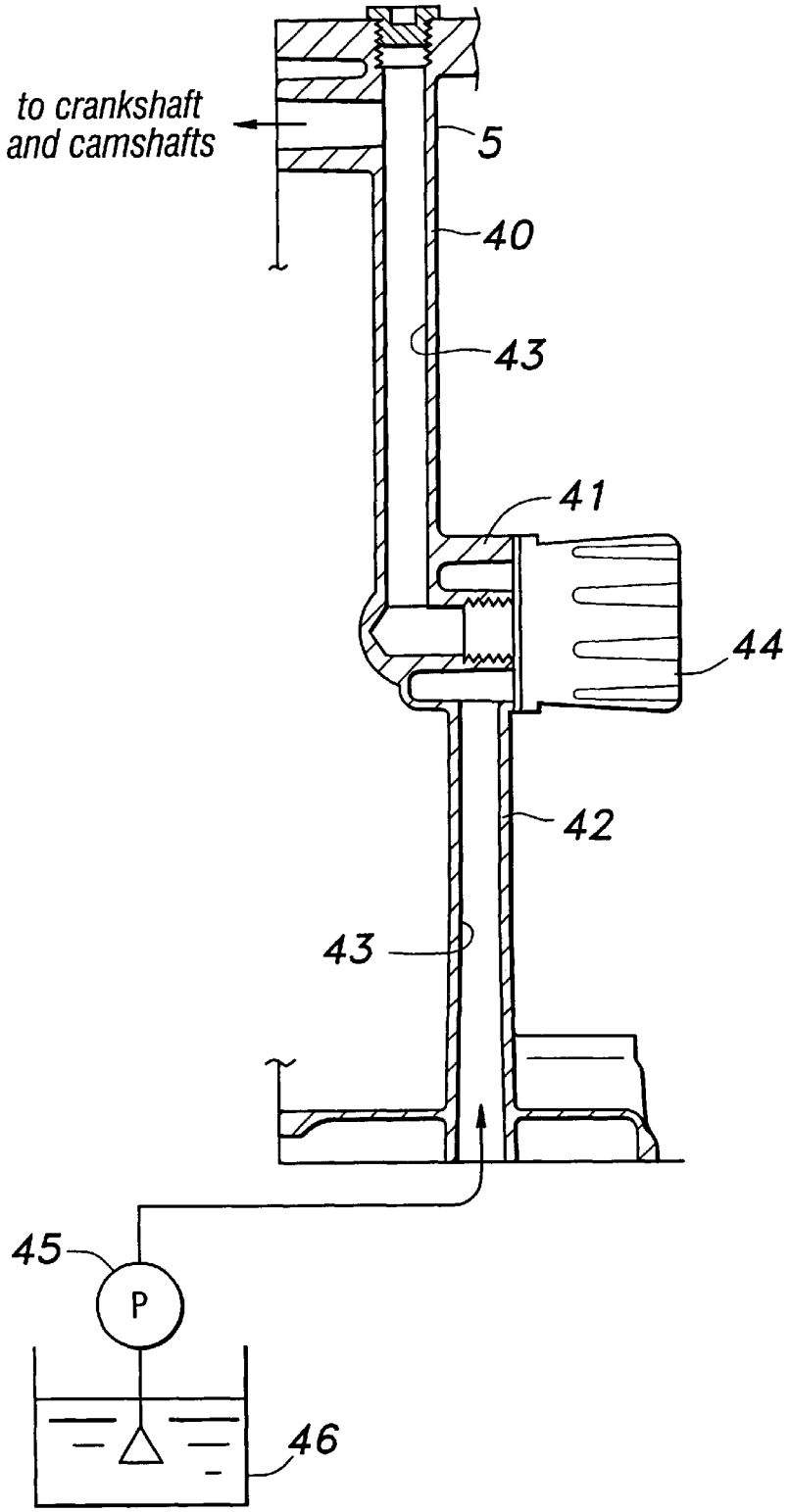
FIG. 4 is a sectional view taken along line IV—IV of FIG. 3.

As shown in FIGS. 3 and 4, in such a vertical engine, an oil gallery is provided in the crankcase 5 to feed the engine oil drawn by an oil pump 45 from an oil sump 46 provided in a lower part of the engine to the crankshaft and camshaft via a passage provided in the upper end of the cylinder block 2. In this embodiment, on the outer surface of the crankcase 5 extend a first ridge 40 between the first and second brackets 30 and 31, and a second ridge 42 between the second bracket 31 and gear housing 6 via an annular boss 41 for mounting an oil filter 44, both in the vertical direction. As best shown in FIG. 4, these ridges 40 and 42 internally define a passage 43 serving as an oil gallery.

Such a relatively large outboard marine engine equipped with a starter motor is required to have an ACG having a corresponding large output capacity, and needs a structure having a mechanical strength that is required for mounting a relatively large and heavy ACG. Therefore, conventionally, relatively large steel brackets were mounted on the upper surface of the crankcase to support a relatively large and heavy ACG. However, it was sometimes difficult to secure a necessary mounting surface, and the number of components and the amount of the assembly work were unacceptably great. The present invention eliminates such a problem by using ACG mount brackets integrally cast with the crankcase. To ensure a sufficient mechanical strength even when the crankcase has a relatively thin wall, ridges 40 and 42 extend substantially over the entire length of the crankcase and connect the first and second brackets 30 and 31 to each other. Furthermore, these ridges also contribute to a compact design of the engine as they are used for defining a passage 43 serving as an oil gallery.

Thus, the present invention provides a generator mounting structure having an adequate mechanical strength which is both compact and light in weight at low cost. In particular, if a hollow ridge is integrally cast with the crankcase to define an oil gallery therein, and connected to the bracket, an even more compact and light-weight design becomes possible.

Although the present invention has been described in terms of a preferred embodiment thereof, it is obvious to a person skilled in the art that various alterations and modifications are possible without departing from the scope of the present invention which is set forth in the appended claims.

What is claimed is:

1. A generator mounting arrangement for vertical engines having a substantially vertically oriented crankshaft, a cylinder block having a cylinder axial line disposed substantially horizontally, a cylinder head attached to a corresponding side of said cylinder block to define a combustion chamber, a crankcase fixedly attached to another side of said cylinder block to define a crank chamber accommodating said crankshaft, a generator fixedly attached to an outer side of said crankcase and having an input shaft extending vertically upward, a driven pulley secured to said generator input shaft, a drive pulley attached to an upper end of said crankshaft, and an endless belt passed around said two pulleys, wherein:

said generator is fixedly attached to said crankcase via a bracket integrally cast with said crankcase; and wherein a hollow ridge is integrally cast with said crankcase to define an oil gallery therein, and connected to said bracket.

2. A generator mounting arrangement for vertical engines according to claim 1, wherein at least two brackets are integrally cast with said crankcase, one being provided with a pivot hole for pivotally supporting said generator, the other being provided with an arcuate slot for fixedly securing said generator at a desired angular position around said pivot hole.

3. A generator mounting arrangement for outboard marine drives including a vertical engine and a propulsion unit connected to a lower end of said engine, said engine comprising a cylinder block having a cylinder axial line disposed substantially horizontally, a cylinder head attached to a corresponding side of said cylinder block to define a combustion chamber, a crankcase fixedly attached to another side of said cylinder block to define a crank chamber accommodating said crankshaft, a generator fixedly attached to an outer side of said crankcase and having an input shaft extending vertically upward, a driven pulley secured to said generator input shaft, a drive pulley attached to an upper end of said crankshaft, and an endless belt passed around said two pulleys, wherein:

said generator is fixedly attached to said crankcase via a bracket integrally cast with said crankcase; and wherein a hollow ridge is integrally cast with said crankcase to define an oil gallery therein, and connected to said bracket.

4. A generator mounting arrangement for vertical engines according to claim 3, wherein at least two brackets are integrally cast with said crankcase, one being provided with a pivot hole for pivotally supporting said generator, the other being provided with an arcuate slot for fixedly securing said generator at a desired angular position around said pivot hole.

* * * * *